US011388498B1

(12) United States Patent
Batson et al.

(10) Patent No.: US 11,388,498 B1
(45) Date of Patent: Jul. 12, 2022

(54) BINAURAL HEARING DEVICE WITH MONAURAL AMBIENT MODE

(71) Applicant: GN Audio A/S, Ballerup (DK)

(72) Inventors: Kevin A. Batson, Ballerup (DK); David M. Geno, Ballerup (DK); Martin E. Granville, Ballerup (DK); Thomas F. Terrien, Jr., Ballerup (DK)

(73) Assignee: GN Audio A/S, Ballerup (DK)

( * ) Notice: Subject to any disclaimer, the term of this patent is extended or adjusted under 35 U.S.C. 154(b) by 0 days.

(21) Appl. No.: 17/137,817

(22) Filed: Dec. 30, 2020

(51) Int. Cl.
*H04R 3/00* (2006.01)
*H04R 1/10* (2006.01)
*H04R 1/08* (2006.01)

(52) U.S. Cl.
CPC ..... *H04R 1/1008* (2013.01); *H04R 1/08* (2013.01); *H04R 2420/07* (2013.01)

(58) Field of Classification Search
CPC ..... H04R 1/10; H04R 1/1008; H04R 1/1083; H04R 1/1041; H04R 1/08; H04R 1/083; H04R 1/028; H04R 25/00; H04R 25/30; H04R 25/609; H04R 2420/07; G10K 11/16; G10K 11/175; G10K 11/178; G10K 11/1783
See application file for complete search history.

(56) References Cited

U.S. PATENT DOCUMENTS

2010/0215198 A1* 8/2010 Ngia ..... H04R 1/1016 381/309
2010/0246836 A1* 9/2010 Johnson, Jr. ..... H04R 5/04 381/58
2011/0206217 A1* 8/2011 Weis ..... H04R 1/10 381/74
2011/0222701 A1* 9/2011 Donaldson ..... H04R 1/1091 381/74
2012/0257764 A1* 10/2012 Sung ..... H04R 1/1083 381/74
2014/0126736 A1 5/2014 Gauger, Jr. et al.
2015/0222977 A1* 8/2015 Angel, Jr. ..... H04R 1/105 381/74
2016/0198253 A1* 7/2016 Shin ..... H04M 1/6058 381/58
2017/0263236 A1* 9/2017 Boesen ..... G10K 11/17861
2018/0034951 A1* 2/2018 Boesen ..... H04M 1/6066
2018/0132032 A1* 5/2018 Boesen ..... H04R 1/1091
2018/0301134 A1* 10/2018 Le ..... H04R 1/1083
2020/0174734 A1 6/2020 Gomes et al.

OTHER PUBLICATIONS

The extended European search report issued in European application No. 21215043.7, dated May 25, 2022.

* cited by examiner

*Primary Examiner* — Thang V Tran
(74) *Attorney, Agent, or Firm* — Hamre, Schumann, Mueller & Larson, P.C.

(57) ABSTRACT

A hearing device comprising a first earphone with a first driver unit and a second earphone comprising a second driver unit. The headset further comprises a first ambient microphone adapted for converting ambient noise to an ambient input signal. A first electric circuitry is adapted for receiving the first ambient input sound signal from the ambient microphone and in an ambient mode outputting a first ambient output sound signal of a certain level to the first driver unit. An activation circuit is adapted to activate and deactivate the ambient mode for the hearing device. In the ambient mode, the ambient output sound signal is sent to the first driver unit and not the second driver unit.

18 Claims, 5 Drawing Sheets

BINAURAL HEARING DEVICE WITH MONAURAL AMBIENT MODE

TECHNICAL FIELD

The specification relates to a hearing device and a hearing device system comprising a first earphone comprising a first driver unit, a second earphone comprising a second driver unit, a first ambient microphone adapted for converting ambient noise to a first ambient input signal, a first electric circuitry adapted for receiving the first ambient input sound signal from the first ambient microphone and in an ambient mode outputting a first ambient output sound signal to the first driver unit, an activation circuit adapted to activate and deactivate the ambient mode for the hearing device.

BACKGROUND ART

Hearing devices, such as headsets and headphones, become more and more popular. They exist in many different form factors. This specification only relates to hearing devices and hearing device systems comprising two earphones, such that audio can be directed to both ears of a user. Thus, the specification relates to hearing devices, which can be termed stereo headphones, duo headsets, binaural headsets and stereo headsets. When using a binaural headset, both ears can receive audio, which can give a better experience when listening to music. It may also be easier for the user to hear the audio and not being disturbed by ambient noise. Especially when using active noise cancellation earphones, which can circumaural, ambient noise can be prevented very efficiently from accessing the user's ears. Active noise cancellation is a technology, where ambient noise waves are phase-inverted to create "anti-noise", which is sent to the earphone's driver unit. The anti-noise cancels the noise at the user's ear.

A potential disadvantage by such headsets and headphones is, that the user gets acoustically isolated from the surroundings, which is undesirable in certain situations. Therefor, it is normally possible to switch off the noise cancellation feature and even switch on an "ambient mode", where ambient noise is not phase inverted but sent more or less amplified to the driver unit, and thereby short-circuiting the passive noise cancellation provided by the earphone housing blocking the ear canal from the surroundings. In this ambient mode, the user can hear the surroundings and talk to other people directly without taking the headset off.

There exist headphones, where one of the earphones can be detached or rotated away from the ear, so that the user simultaneously can hear received audio with one ear and ambient noise with the other ear.

DISCLOSURE OF INVENTION

A hearing device may comprise a first earphone comprising a first driver unit, a second earphone comprising a second driver unit, a first ambient microphone adapted for converting ambient noise to a first ambient input signal, a first electric circuitry adapted for receiving the first ambient input sound signal from the first ambient microphone and in an ambient mode outputting a first ambient output sound signal of a certain level to the first driver unit, an activation circuit adapted to activate and deactivate the ambient mode for the hearing device, in the ambient mode, the first ambient output sound signal is sent to the first driver unit and not the second driver unit.

With such a solution, it may be possible for the user to hear audio transmitted to the hearing device clearly in one ear while hearing the ambient noise clearly with the other ear, without having to move one of the earphones away from the ear. Thus, a user, which is having a phone call over his headset, can navigate in a safer manner in a potentially dangerous environment with traffic.

According to an embodiment, the first ambient sound signal is tuned to mainly lead human voices through and not other noise. Thus, in a crowded airport, the user may hear speech such as flight announcements without hearing other noises.

According to an embodiment, the ambient mode may be manually activate or deactivated by a button on the headset.

The ambient output sound signal is of a certain level, which means, that the user will be able to hear the ambient noise clearly, almost as he was not wearing the second earphone.

According to an embodiment, the activation circuit comprises a motion detector adapted to detect a motion of the hearing device and generate a motion output signal in dependence on the detected motion, and in that the ambient mode is activated and deactivated in dependence of the detected motion. Thus, is situations, where the user moves, the ambient mode may be automatically switched on.

According to an embodiment, the motion detector comprises an accelerometer.

According to an embodiment, the motion detector comprises a satellite navigation sensor, such as sensor based on GPS, GLONASS, Galileo or BeiDou.

According to an embodiment, the hearing device enters the ambient mode, when the motion detector detects a linear speed of the hearing device above a certain speed threshold.

According to an embodiment, the speed threshold is about 5 mph. It could also be 3, 4, 6, 7, 8, 9, 10, 11, 12, 13, 14, 15, 16, 17, 18, 19 or 20 mph. Alternatively, it could be 5, 6, 7, 8, 9, 10, 11, 12, 13, 14, 15, 16, 17, 18, 19, 20, 21, 22, 23, 24, 25, 26, 27, 28, 29 or 30 km/t.

According to an embodiment, the ambient mode is a mode, where the user clearly can hear ambient sounds.

According to an embodiment, the hearing device comprises a visual indicator adapted to indicate, when the headset is in the ambient mode.

According to an embodiment, the hearing device comprises a first active noise cancellation circuit, which is adapted to generate a first anti-noise signal from a first ambient noise signal.

According to an embodiment, the first active noise cancellation circuit is receiving the first ambient noise signal from the first ambient microphone.

According to an embodiment, the first anti-noise signal is sent to the first driver unit when the headset is in an ANC mode.

According to an embodiment, the hearing device comprises a second noise cancellation circuit and a second ambient microphone, wherein the second noise cancellation circuit generates a second anti-noise signal from a second ambient noise signal received from the second ambient microphone, which can be sent to the second driver unit.

According to an embodiment, the second anti-noise signal is sent to the second driver unit, when the headset is in the ambient mode.

According to an embodiment, the hearing device comprises a voice microphone to be used for to-way communication.

According to an embodiment, the hearing device comprises a microphone arm, which in a use situation is extending from the first earphone, and which comprises the voice microphone.

According to an embodiment, the hearing device is adapted to be connected to an audio gateway, such as a smartphone, and receive an audio signal form the audio gateway.

According to an embodiment, the hearing device is adapted play back the received audio signal by the first driver unit only in the ambient mode.

According to an embodiment, the hearing device is adapted to play back the received audio signal by the first driver unit and the second driver unit.

According to an embodiment, the hearing device comprises a wireless transceiver, whereby it can be wirelessly connected to a device comprising a corresponding wireless transceiver.

According to an embodiment, the wireless transceiver is a Bluetooth transceiver.

The specification also relates to a hearing device system comprising

- a first earphone comprising a first driver unit, a first ambient microphone adapted for converting ambient noise to an ambient input signal, a first electric circuitry adapted for receiving the ambient input sound signal from the first ambient microphone and in an ambient mode outputting an ambient output sound signal of a certain level to the first driver unit,
- a second earphone comprising a second driver unit,
- an activation circuit adapted to activate and deactivate the ambient mode for the hearing device, and where in the ambient mode, the ambient output sound signal is sent to the second driver unit and not the first driver unit.

According to an embodiment, the hearing device system comprises an external device, which comprises the activation circuit, and which is wirelessly connected to the first earphone and the second earphone.

According to an embodiment, the external device is a smartphone.

In a complete alternative embodiment, an ambient output signal of a certain level may be sent to both the first driver unit and the second driver unit, as a result of movement.

BRIEF DESCRIPTION OF THE DRAWINGS

The invention is explained in detail below with reference to the drawing illustrating preferred embodiments of the invention and in which.

MODES FOR CARRYING OUT THE INVENTION

Figure 1:
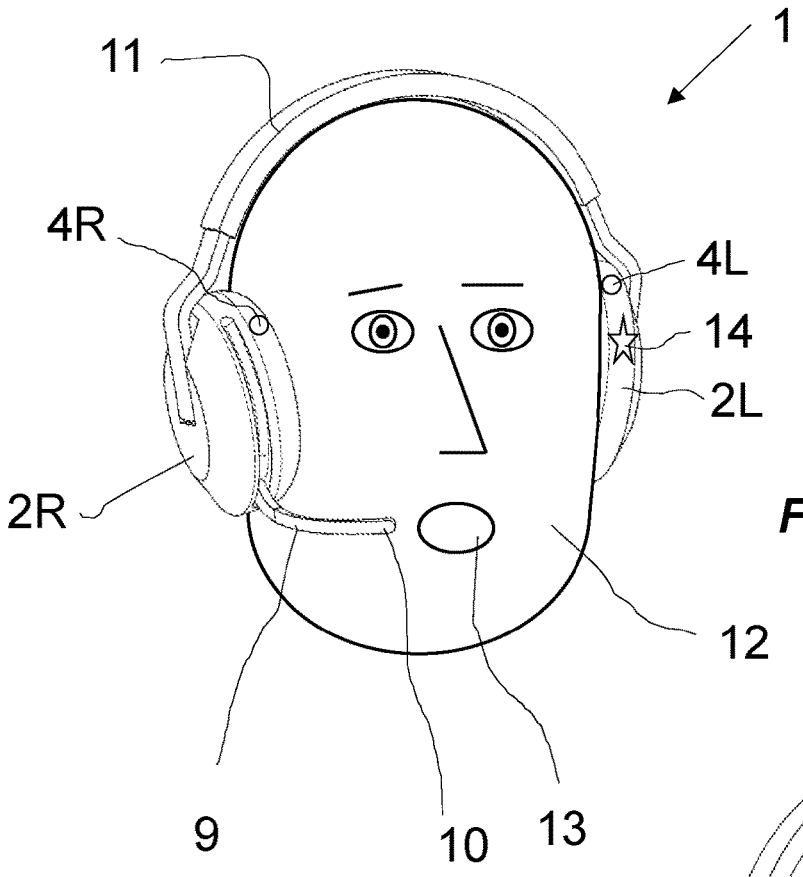
FIG. 1 is a headset in use.

FIG. 1 is a headset 1 arranged on the head of a user 12. The headset 1 comprises a first earphone 2L, a second earphone 2R, a headband 11 connecting the first and second earphones 2L, 2R. The first earphone 2L, which is arranged on the left ear of the user 12, comprises a first ambient microphone 4L and a LED indicator 14. The second earphone 2R comprises a second ambient microphone 4R. A microphone arm 9 extends from the second earphone 2R with a voice microphone 10 at the tip of the microphone arm 9 so it can be arranged close to the user's mouth 13.

Figure 2:
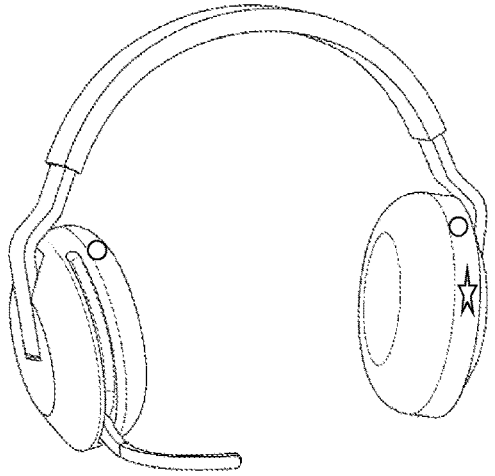
FIG. 2 is the headset alone.

FIG. 2 is the headset 1 in a state where it is ready to be put on a user's head.

Figure 3:
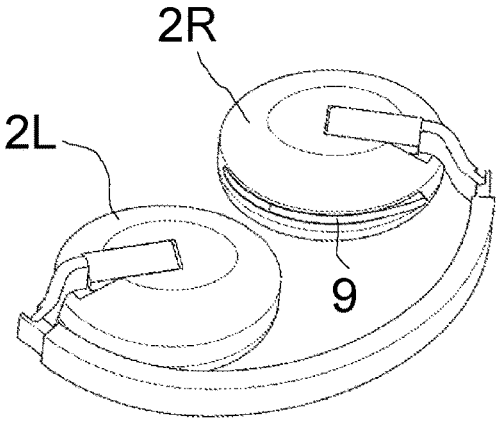
FIG. 3 is the headset in collapsed state.

FIG. 3 is the headset 1 in collapsed state, where it takes up less space and is easier to stow away and transport. The microphone arm 9 is folded into a recess in the second earphone 2R.

Figure 4:
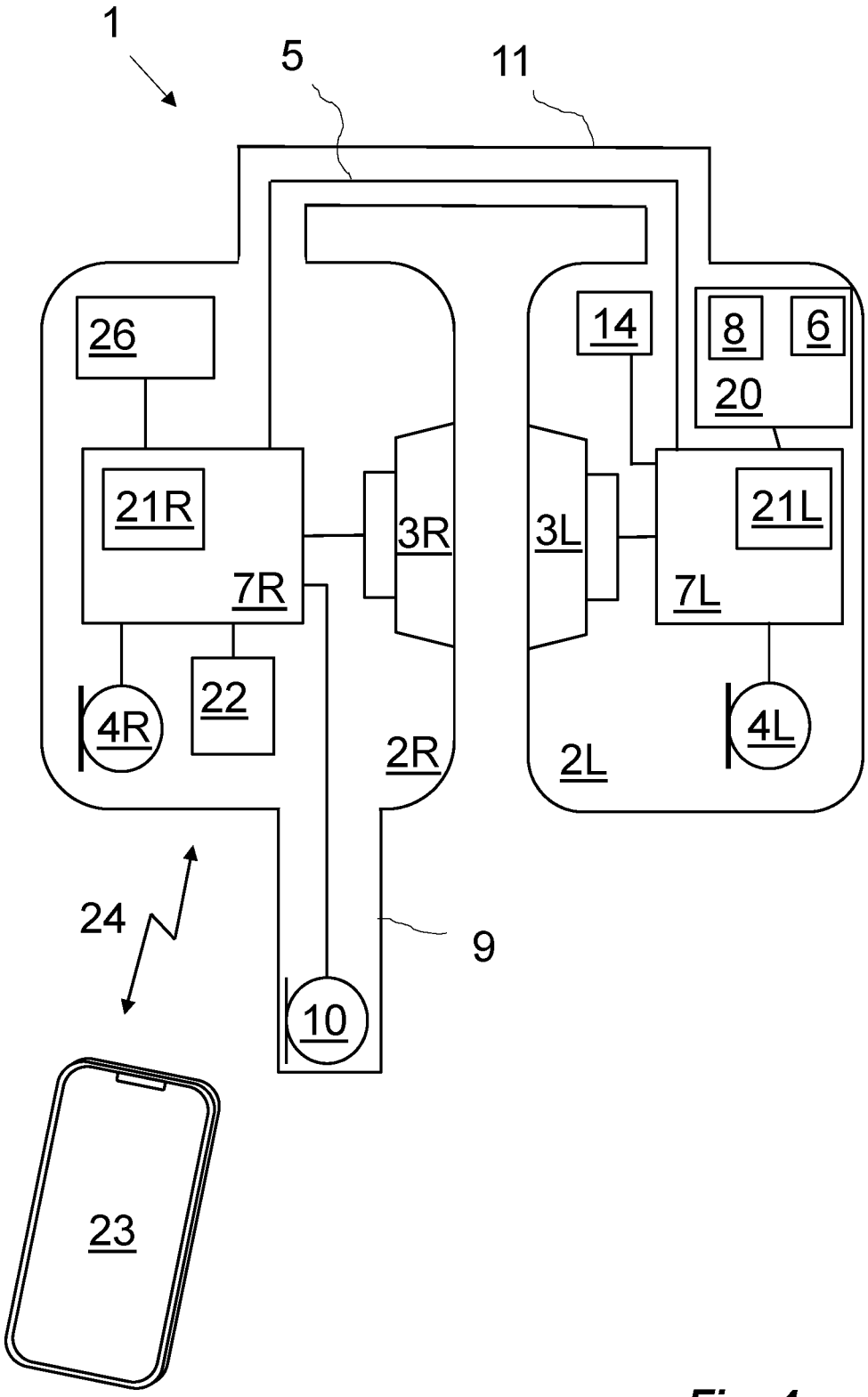
FIG. 4 is a diagram of the headset with its main components and a connected smartphone.

FIG. 4 is a diagram of the headset 1 with its main components. The first earphone 2L comprises a first driver unit 3L, a first circuit 7L with a first ANC circuit 21L, the first ambient microphone 4L and an activation circuit 20 with a motion detector 8 and a button 5. The second earphone 2R comprises a second driver unit 3L, a second circuit 7R with a second ANC circuit 21R, the second ambient microphone 4R, a Bluetooth transceiver 22 and a rechargeable battery 26. A wire 5 extends through the headband 11, which connects the two earphones 2L, 2R. As both earphones 2L, 2R has an active noise cancellation circuit 21L, 21R, ambient noise can efficiently be hindered in reaching the user's ear canals. The headset 1 is wirelessly connected by a Bluetooth link 24 to a Bluetooth enabled smartphone 23, whereby the user 12 can use the headset for two-way telecommunication via the smartphone 23 and listen to audio content streamed from the smartphone 23 to the headset 1. If the user 12 wants, he can activate the ANC on both earphones 2L, 2R by using an associated app on the smart phone 23 or pushing a not shown button on the headset 1. The app may also provide the possibility of making user defined pre-settings, where the ANC is automatically activated in certain cases, f. ex, if there is a high level of ambient noise, during phone calls, when the user finds himself in certain geographical locations determined by GPS or Wi-Fi connections etc. If the user is having a phone call in an environment, where he must be aware of his surroundings, it could be in a warehouse or out in the traffic, it may be dangerous to be acoustically isolated from the surroundings, and it is therefore not recommended to use ANC here. However, switching off ANC may not be enough, as the earphones 2L, 2R may cause high passive noise cancellation or reduction. Therefore, it is known to provide a "transparency mode" or HearThrough™ mode, where the noise captured by the ambient microphones are not phase inverted but sent more or less amplified to the driver unit, so the user can hear the surroundings clearly. Until now, three modes have been described: 1. Normal mode, where ANC is switched off, 2. ANC mode, where ANC is switched on for both earphones, and 3. transparency mode, mode where ambient noise is captured by microphones and sent to the driver units 3L, 3R. However, none of these modes are suitable for situations, where a user must hear audio clearly from the headset 1 and be able to hear surroundings clearly at the same time. Therefore, the headset shown in FIGS. 1-4 has a fourth mode, which is called "ambient mode" here. In "ambient mode", the first electric circuitry 7L receives a first ambient input sound signal from the first ambient microphone 4L and outputs a first ambient output sound signal of a certain level to the first driver unit 3L. Thus, the user can hear ambient sounds clearly through the first driver unit 3L, and simultaneously hear audio received from the smartphone 23 via the second earphone 2R. The second ANC circuit 21R is active in the second earphone 2R in ambient mode. In another embodiment, the second ANC circuit 21R could be inactive in ambient mode. The motion detector 8 of the activation circuit 20, is based on an accelerometer. This motion detector 8 is able to detect linear speed of the headset 1. If the speed exceeds 5 mph, the activation circuit 20 activates the ambient mode. This is particularly advantageous, because the headset 1 automatically will enters ambient mode, if the user starts driving a vehicle. In certain states in the US, it is only allowed to wear a single-sided headsets or headphones (i.e. earphones only on or in one ear). With this headset 1, the ambient mode corresponds to a single-sided headset. The motion detector could also be based on satellite navigation, such as GPS. The button 6 of the activation circuit 20 is used to activate an deactivate the ambient mode. Thus, the user 26 may choose to annually activate the ambient mode, if he wants to hear ambient noise while having a phone call. The first ambient noise signal may be tuned to primarily let speech through, so that other noises that human speech is not directed to the ear as much as the speech. Thus, the user may hear important announcements in a public place, such as an airport or railway-station while being on a phone call.

Figure 5:
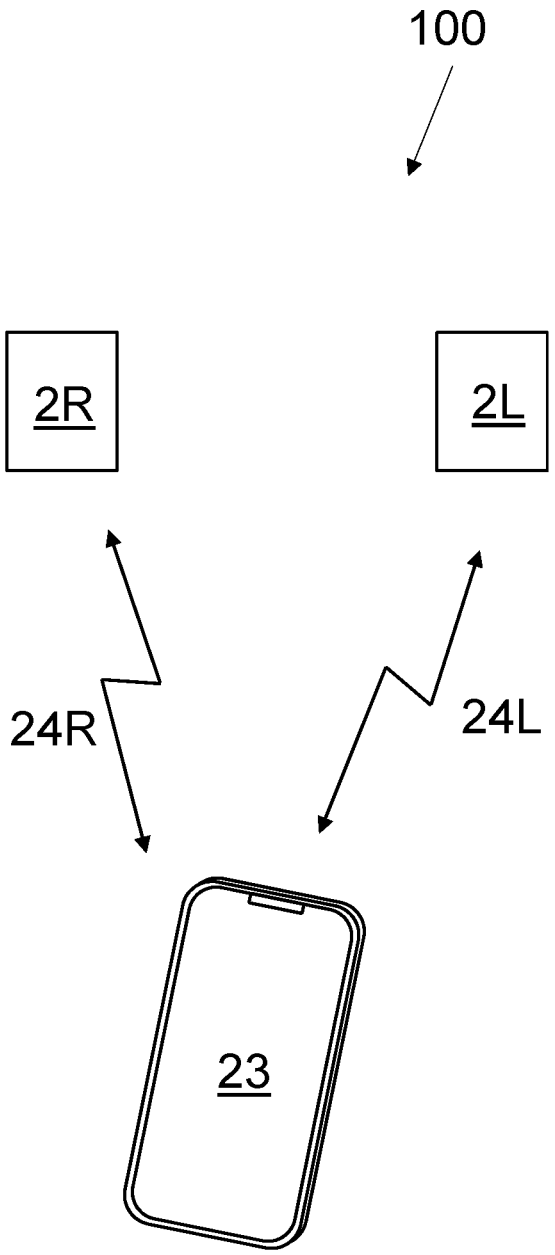
FIG. 5 is a headset system.

FIG. 5 is a headset system 100, which comprises two earphones embodied as true wireless earbuds 2L, 2R. These are both wirelessly connected to a smartphone 23 by Bluetooth links 24L, 24R. Motion is detected by the smartphone 23, which activates transparency mode in one of the earbuds 2L, 2R. The smartphone 23 can detect motion in different ways, f. ex. by an internal accelerometer-based motion sensor or built-in GPS.

Figure 6:
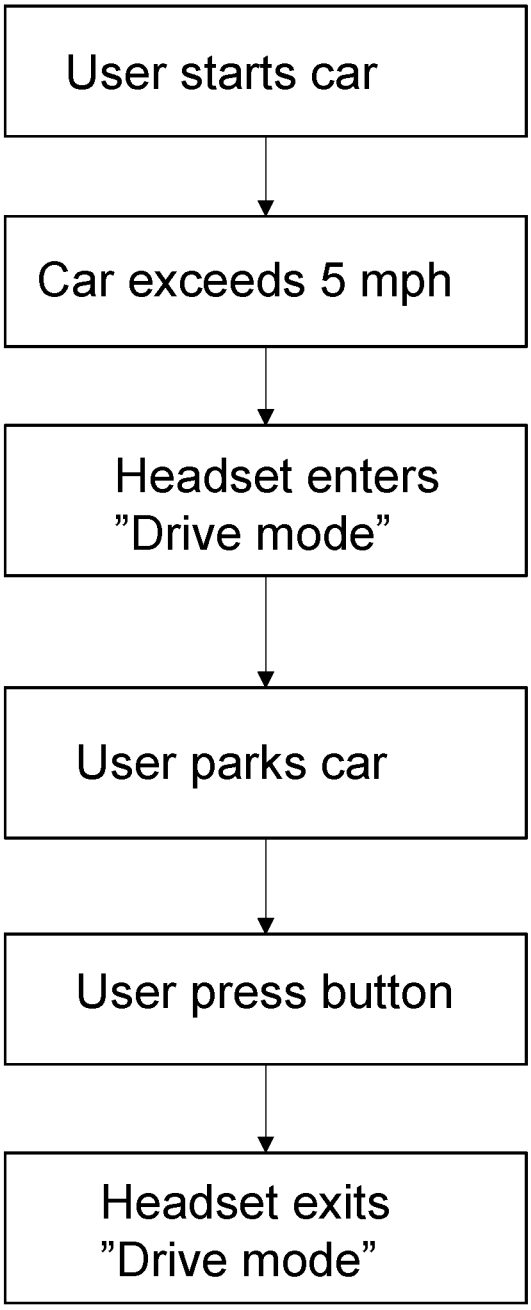
FIG. 6 is a process diagram showing the use of a headset.

FIG. 6 is a process diagram showing the use of a headset 1. A user wearing the headset 1 is entering his car. He starts driving, and when the motion sensor 8 of the headset 1 detects, that the headset 1 and thus the car, reaches a speed of 5 mph, the headset 1 enters ambient mode, where the first earphone gets into transparency mode. At the same time the LED indicator 14 on the first earphone 2L starts lighting, which indicates ambient mode. It is advantageous, that the first earphone 2L is arranged on the left ear of the user, as other people, such as police officers easier can see through the window of the left car door, that the headset is in ambient mode, which increases traffic safety. This, off course, applies to countries where the steering wheel is to the right. The headset 1 should not exit ambient mode, every time the car stops for red light or make other short stops. Therefore, deactivation of the ambient mode requires manual action. After the user has parked the car, he presses a button, whereby the headset 1 exits ambient mode.

Figure 7:
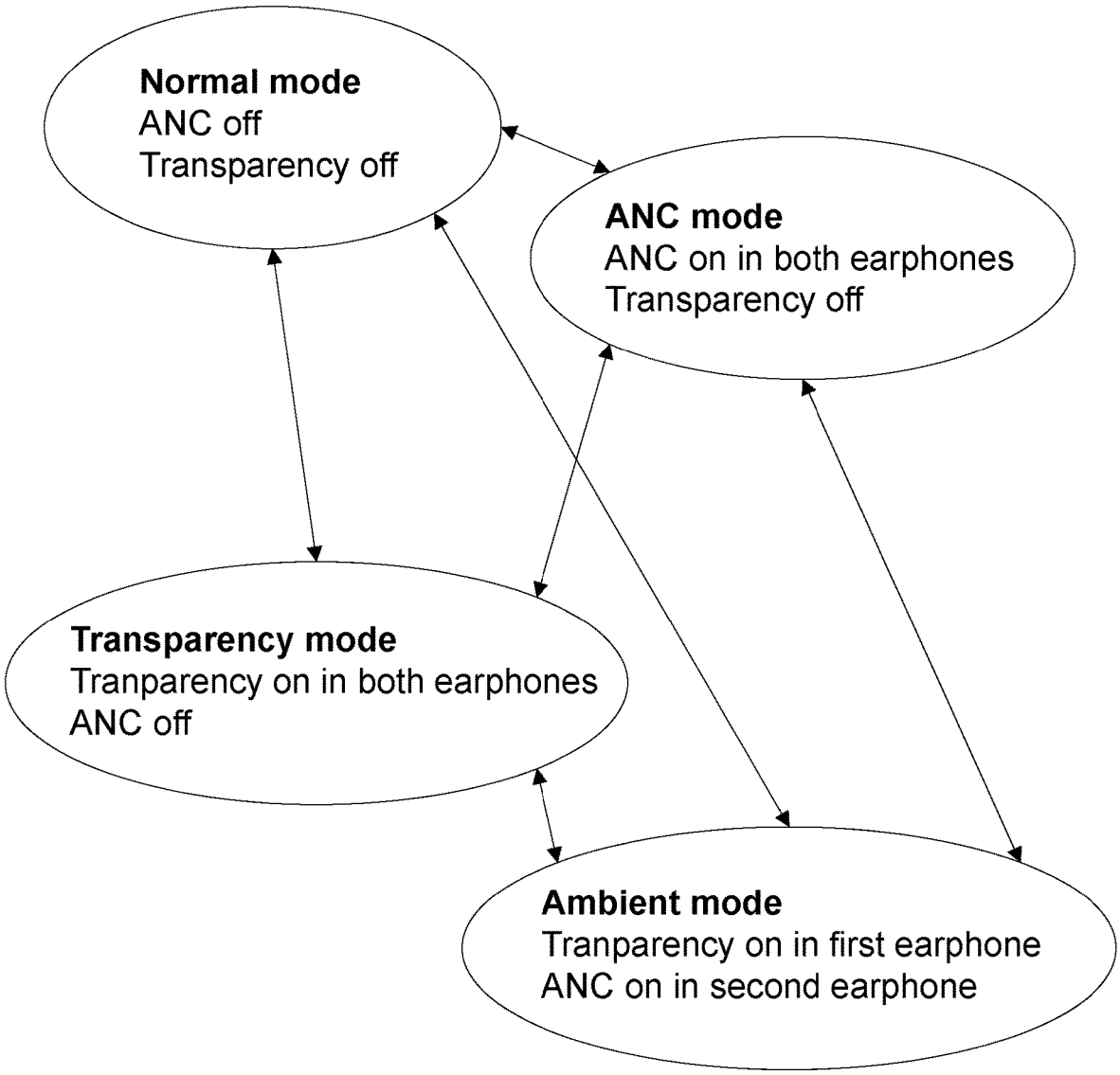
FIG. 7 is a diagram showing different modes of the headset.

FIG. 7 is a diagram showing different modes of the headset. As seen the headset 1 can jump between the four modes: Normal, Transparency, ANC and Ambient.

REFERENCE SIGNS

1 Headset
2L First earphone
2R Second earphone
3L First driver unit
3R Second driver unit
4L First ambient microphone
4R Second ambient microphone
5 Wire
6 Button
7L First electric circuitry
7R Second Electric circuitry
8 Motion detector
9 Microphone arm
10 Voice microphone
11 Headband
12 User
13 Mouth
14 LED indicator
20 Activation circuit
21 ANC circuit
22 Bluetooth transceiver
23 Smartphone
24 Bluetooth link
25 Conductor
26 Rechargeable battery

The invention claimed is:

1. A hearing device comprising
a first earphone comprising a first driver unit, a first ambient microphone configured for converting ambient noise to a first ambient input signal,
a second earphone comprising a second driver unit,
a first electric circuitry configured to receive the first ambient input signal from the first ambient microphone and in an ambient mode outputting a first ambient output sound signal of a certain level to the first driver unit,
an activation circuit configured to activate and deactivate the ambient mode for the hearing device,
wherein in the ambient mode, the first ambient output sound signal is sent to the first driver unit and not the second driver unit; and
wherein the activation circuit comprises a motion detector configured to detect a motion of the hearing device and generate a motion output signal in dependence on the detected motion, and in that the ambient mode is activated and deactivated in dependence of the detected motion.

2. A hearing device according to claim 1, wherein the motion detector comprises an accelerometer.

3. A hearing device according to claim 2, wherein the motion detector comprises a satellite navigation sensor including sensor based on GPS, GLONASS, Galileo or BeiDou.

4. A hearing device according to claim 1, wherein the hearing device enters the ambient mode, when the motion detector detects a linear speed of the hearing device above a certain speed threshold.

5. A hearing device according to claim 4, wherein the speed threshold is about 5 mph.

6. A hearing device according to claim 1, wherein the ambient mode is a mode, where the user clearly can hear ambient sounds.

7. A hearing device according to claim 1, wherein the hearing device comprises a visual indicator configured to indicate, when the headset is in the ambient mode.

8. A hearing device according to claim 1, wherein the hearing device comprises a first active noise cancellation circuit, which is configured to generate a first anti-noise signal from a first ambient noise signal.

9. A hearing device according to claim 8, wherein the first active noise cancellation circuit is receiving the first ambient noise signal from the first ambient microphone.

10. A hearing device according to claim 8, wherein the first anti-noise signal is sent to the first driver unit when the headset is in an ANC mode.

11. A hearing device according to claim 9, which comprises a second noise cancellation circuit, and a second ambient microphone, wherein the second noise cancellation circuit generates a second anti-noise signal from a second ambient noise signal received from the second ambient microphone, which can be sent to the second driver unit.

12. A hearing device according to claim 11, wherein the second anti-noise signal is sent to the second driver unit, when the headset is in the ambient mode.

13. A hearing device according to claim 1 comprising a voice microphone to be used for to-way communication.

14. A hearing device according to claim 12, wherein the hearing device comprises a microphone arm, which in a use situation is extending from the first earphone, and which comprises the voice microphone.

15. A hearing device according to claim 14, which in the ambient mode is configured to play back the received audio signal by the first driver unit only.

16. A hearing device according to claim 1, which is configured to be connected to an audio gateway including, a smartphone, and receive an audio signal form the audio gateway.

17. A hearing device according to claim 1, which comprises a wireless transceiver configured to be wirelessly connected to an audio gateway comprising a corresponding wireless transceiver.

18. A hearing device system comprising a first earphone comprising a first driver unit, a first ambient microphone configured for converting ambient noise to an ambient input signal, a first electric circuitry configured for receiving the ambient input sound signal from the first ambient microphone and in an ambient mode outputting an ambient output sound signal of a certain level to the first driver unit, a second earphone comprising a second driver unit, an activation circuit configured to activate and deactivate the ambient mode for the hearing device, and where in the ambient mode, the ambient output sound signal is sent to the first driver unit and not the second driver unit; and further including an external audio gateway, which comprises the activation circuit, and which is wirelessly connected to the first earphone and the second earphone.

* * * * *